US005183215A

United States Patent [19]

Getzmann

[11] Patent Number: 5,183,215

[45] Date of Patent: Feb. 2, 1993

[54] GRINDING APPLIANCE

[76] Inventor: Hermann Getzmann, Biebersteiner Str. 17, 5226 Reichshof-Heienbach, Fed. Rep. of Germany

[21] Appl. No.: 477,949

[22] PCT Filed: Nov. 9, 1988

[86] PCT No.: PCT/DE88/00695

§ 371 Date: Jun. 1, 1990

§ 102(e) Date: Jun. 1, 1990

[87] PCT Pub. No.: WO89/05191

PCT Pub. Date: Jun. 15, 1989

[30] Foreign Application Priority Data

Dec. 3, 1987 [DE] Fed. Rep. of Germany ..... 3740898

[51] Int. Cl.[5] ..... B02C 17/16

[52] U.S. Cl. ..... 241/62; 241/97; 241/171; 241/172

[58] Field of Search ..... 241/171, 172, 98, 97, 241/80, 62

[56] References Cited

U.S. PATENT DOCUMENTS

| | | | |
|---|---|---|---|
| 2,621,859 | 12/1952 | Phillips | 241/62 X |
| 3,307,792 | 3/1967 | Hughes et al. | 241/172 X |
| 3,458,144 | 7/1969 | Lesells et al. . | |
| 3,957,210 | 5/1976 | Durr | 241/171 X |
| 4,308,998 | 1/1982 | Wood | 241/171 X |
| 4,394,980 | 7/1983 | Marz et al. | 241/62 X |
| 4,834,301 | 5/1989 | Inkyo et al. | 241/172 X |

FOREIGN PATENT DOCUMENTS

| | | | |
|---|---|---|---|
| 0015647 | 9/1980 | European Pat. Off. . | |
| 74633 | 3/1983 | European Pat. Off. | 241/171 |
| 1212825 | 3/1966 | Fed. Rep. of Germany . | |
| 2432860 | 1/1976 | Fed. Rep. of Germany . | |
| 3543190 | 6/1987 | Fed. Rep. of Germany . | |
| 1472184 | 3/1967 | France . | |
| 657848 | 4/1979 | U.S.S.R. | 241/171 |
| 689722 | 10/1979 | U.S.S.R. | 241/171 |

*Primary Examiner*—Mark Rosenbaum
*Attorney, Agent, or Firm*—Diller, Ramik & Wight

[57] ABSTRACT

A grinding appliance, intended especially for grinding material in the form of flowable or pasty conglomerates, consists of a housing (1) with an inlet chamber (2), a grinding chamber (3) for receiving grinding balls and an outlet (4). A rotatably mounted agitator body (5) which can be driven by means of a motor (7) is arranged in the grinding chamber. So that the conveyance can be controlled in a simple way independently of the rotational speed of the agitator body, the inlet chamber (2) is preceded by a storage vessel (46) which is equipped with an air-pressure connection (50) and which is sealingly closeable (FIG. 1). Alternatively, a pump can also be inserted in the storage vessel and the air-pressure connection be selectively exchangeable with a return connection.

22 Claims, 4 Drawing Sheets

GRINDING APPLIANCE

BACKGROUND OF THE INVENTION

The invention relates to a grinding appliance, especially for grinding material in the form of flowable or pasty non-flowable conglomerates, consisting of a housing having an inlet chamber, a grinding chamber for receiving grinding balls and an outlet, of a rotatably mounted agitator body arranged in the grinding chamber and of a drive for the agitator body.

In a known grinding apparatus of the type mentioned (EP-A-0,015,647), the inlet chamber is preceded by an open filling funnel, to which the grinding material is introduced in batches or continuously. The grinding material passes from the filling funnel into the inlet chamber, out of which it is conveyed into the grinding chamber by means of a conveyor worm and a centrifugal pump. The conveyor worm, the centrifugal pump and the agitator body are arranged on the same shaft and can therefore only ever be driven at the same rotational speed. Since the rotational speed of the agitator body is predetermined within relatively narrow limits, in the known grinding appliance it is possible to execute only a grinding program by which the most diverse grinding materials are treated during approximately the same dwell time.

SUMMARY OF THE INVENTION

A further disadvantage of the known grinding appliance is that, as a result of the pump device, e.g. a conveyor worm, following the inlet chamber, there are parts within the grinding appliance which soil easily and can only be cleaned with difficulty if the appliance is to be changed over to a different grinding material. Finally, the known grinding appliance also has a considerable dead volume, so that not inconsiderably quantities of grinding material are left behind in the grinding appliance after completion of the grinding process.

A grinding appliance having a grinding chamber, a rotatably mounted agitator body and a drive for the agitator body is admittedly already known (DE-A-1,212,825), the grinding chamber being preceded by a pump connected into a feed for the grinding material. As a result of the pressure, generated by the pump, on the grinding material, the conveyance of the grinding material can be controlled independently of the rotational speed of the agitator body. Nevertheless, the two other disadvantages mentioned above remain, namely the easy soiling and difficult cleaning of the parts and the existence of a considerable dead volume within the grinding appliance.

The object on which the invention is based is to provide a grinding appliance of the type mentioned at the outset, by means of which the conveyance can be controlled in a simple way independently of the rotational speed of the agitator body, an easy cleaning of the parts within the grinding appliance is permitted as well as a minimal dead volume.

A first solution achieving this object consists in that in a grinding appliance of the type mentioned at the outset, the inlet chamber is preceded by a pneumatic conveyor device, by means of which the grinding material can be pressed through the inlet chamber and the grinding chamber as far as the outlet.

This solution is suitable for every grinding material in the form of flowable or pastry, non-flowable conglomerates. It is used especially wherever the conditions of a pneumatic connection exist.

As a result of the construction according to the invention, the most diverse grinding programs can be executed with the simplest possible means, because the pressure device can be subjected to the most diverse pressures independently of the rotational speed of the agitator body. To that extent, the particular program can be adapted as closely as possible to the grinding material to be treated. Furthermore, in the construction according to the invention, there is no need for a conveyor worm following the inlet chamber or a centrifugal pump, since the conveyance can be carried out solely by means of the pressure device. This does away with the easily soiled parts inside the grinding appliance, which can be cleaned only with difficulty when the appliance is to be changed over to a difficult grinding material. Finally, another advantage of the construction according to the invention is that there is only a minimum dead volume, so that even small and very small quantities of grinding material can be processed with good outputs. The appliance according to the invention is therefore preeminently suitable for performing tasks in research, development and quality control.

The constructional principle according to the invention can be put into practice especially advantageously on laboratory machines, very high outputs being obtainable for one filling.

When flowable grinding material is to be processed, a sealingly closeable storage vessel equipped with an air-pressure connection can be arranged as a pneumatic conveyor device immediately in front of the inlet chamber. With the rotational speed of the agitator body being constant, the air pressure can be set to any value, so that the dwell time of the grinding material can easily be adjusted according to the quality of the grinding material to be processed.

Appropriately, the storage vessel has, on its top side, a filling orifice which can be closed in an air-tight manner by means of a cover. The air-pressure connection is preferably provided on the cover.

A second solution provides that a cylindrical storage vessel, the upper end of which is open, is arranged immediately in front of the inlet chamber, and that a sealingly bearing driveable piston can be inserted into the open end.

This solution is especially preferred whenever a pasty non-flowable grinding material is concerned. The material to be ground is pressed by the piston out of the storage vessel into the inlet chamber, the piston speed being variable independently of the rotational speed of the agitator body and an easy cleaning of the scarcely soiled storage vessel being possible. The dead volume is in this case likewise limited to a minimum, since the grinding material is removed completely from the storage vessel and, due to the direct connection of the inlet chamber, there is scarcely any more space.

A third solution achieving the object underlying the invention consists in that a storage vessel, in the lower part of which a pump device is provided, is arranged immediately in front of the inlet chamber.

This solution is suitable for every grinding material which can be conveyed by a pump and under such conditions in which suitable pumps can be used. As a result of the special arrangement of the pump device in the lower part of the storage vessel and the direct connection between storage vessel and inlet chamber, as in the case of the previously described solution, a soiling of the device of the grinding appliance preceding the inlet chamber is substantially prevented. The dead volume is likewise minimal, so that small and very small quantities of grinding material can be processed with good outputs.

The storage vessel of such a grinding appliance can preferably be equipped with an air-pressure connection. The air pressure is applied when the grinding material in the storage vessel has decreased to such an extent that it can no longer or no longer sufficiently be conveyed by the pump device. This occurs when the grinding material still present is only in that part of the storage vessel located underneath the pump device. In order to process the remainder of this grinding material, the storage vessel is then subjected to compressed air. This appliance is especially expedient when the grinding material is to be processed by a multiplepass method. The grinding material is then allowed to pass as often as desired through the appliance via a return, at the same time being conveyed solely by the pump device. In the last grinding cycle, the return is cut off and the ground product is extracted from the outlet. The grinding material is conveyed via the pump device as long as grinding material is contained in the storage vessel above the pump device. The remaining quantity of grinding material is then conveyed out of the storage vessel, the inlet chamber and finally the grinding chamber and the outlet by means of the compressed air introduced into the storage vessel via the air-pressure connection. The dead volume is thus reduced to a minimum.

Appropriately, the drive motor of the pump device is located above the storage vessel, so that the shaft for driving the pump device engages into the storage vessel vertically from above.

Additionally or alternatively, a dispersing device can also be provided inside the storage vessel.

The agitator or dispersing device can appropriately be driven by the same shaft by which the pump device is also driven.

The agitator device can have one or more propellers and the dispersing device one or more dissolver discs, as required, depending on the particular grinding material used.

The propellers can be arranged so as to be vertically displaceable. This ensures the best possible mixing of the grinding material according to the filling height and viscosity. Relatively large agitator members can be attached because of the upwardly increased spacing of the retaining rods for the housing plate of the centrifugal pump. This is expedient in order to achieve sufficiently thorough mixing at relatively high viscosities or at relatively low rotational speeds.

Preferably, a throttle member is arranged in the cross-section of the outlet of the grinding chamber, so that the work can be carried out at a higher intake pressure.

The throttle member is appropriately designed as an apertured diaphragm which is of simple design and which is easy to clean. The apertured diaphragm can also be arranged exchangeably, so that apertured diaphragms with different aperture sizes can be used for different grinding programs.

The outlet of the housing is preferably formed by a removable plug with a concentric longitudinal channel, the apertured diaphragm being fastened in the longitudinal channel or in front of this.

The plug, appropriately fastened rotatably in the housing, can have a transverse channel which intersects the longitudinal channel and which is guided out of the plug radially on one side. This makes versatile use possible because, by an appropriate setting of the plug, the finished grinding material can be discharged in various directions, as required.

A smooth cylindrical inner body can be arranged in the inlet chamber and, together with a cylindrical inner face of the inlet chamber, forms an annular gap opening into the grinding chamber. In this construction, there are only smooth parts which have an extremely small dead space and which can be cleaned easily.

At a short distance in front of the grinding chamber, the inner body and the inner face of the inlet chamber can form a dynamic friction gap for separating the grinding chamber from the inlet chamber.

The inner body can be designed as a separate part. However, it can also be formed in one piece onto the agitator body. The latter version allows a simplified cleaning of the parts arranged in the grinding appliance. The cleaning facility can be further improved if the inner body is formed in one piece on a protective sleeve arranged in the entry region of the housing and intended for the shaft.

The invention is illustrated by way of example in the drawing and described in detail below by reference to the drawing. In this:

DESCRIPTION OF THE PREFERRED EMBODIMENTS

Figure 1:
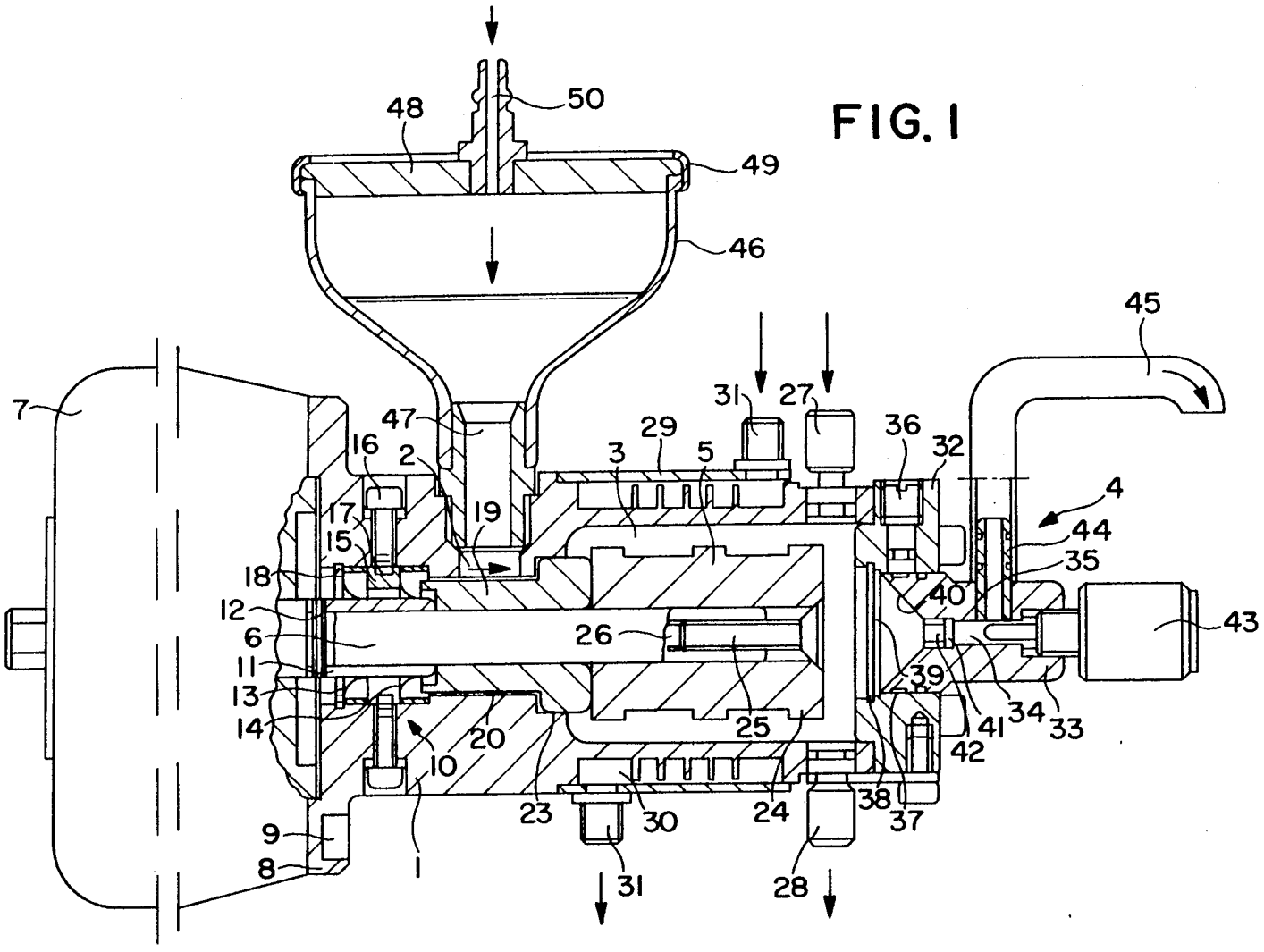
FIG. 1 shows a section through one exemplary embodiment of a grinding appliance.

A grinding appliance provided especially for the laboratory and pilot plant sector is illustrated in FIG. 1 of the drawing.

The grinding appliance consists essentially of a housing 1 with an inlet chamber 2, a grinding chamber 3 and an outlet 4.

Inside the grinding chamber 3 designed essentially as a horizontal cylinder is arranged an agitator body 5 which is mounted rotatably about a horizontal axis. The agitator body 5 is arranged on the shaft 6 of an electric motor 7 which is located on the side of the housing 1 opposite the outlet 4. To connect the electric motor to the housing 1, the latter is equipped, on the side facing the electric motor 7, with a flange 8 by means of which the housing is screwed to the electric motor by means of screws 9.

The shaft 6 extends through an entry region 10 of the housing 1, through the inlet chamber 2 and into the grinding chamber 3.

In the entry region 10, the shaft 6 is equipped with a protective sleeve 11 which is fastened fixedly in terms of rotation on the shaft 6 by means of a clamping pin 12. Arranged in the region of the protective sleeve 11 are two sealing rings 13 and 14 which seal off the shaft from the housing. The inner sealing ring 14 rests with its side facing the inlet chamber 2 against an inner housing step and on its other side is retained by means of a scavenging ring 15. The scavenging ring 15 is connected to the outside of the housing 1 via radial threaded bores 17. The outer sealing ring 13 rests against the scavenging ring 15 and is secured relative to the outside by means of a retaining ring 18. If required, a scavenging-fluid circuit guaranteeing an even better sealing of the shaft 6 relative to the housing 1 can be connected to the threaded bores 17. If no scavenging fluid is needed, the threaded bores 17 can be closed by means of screws 16 and gaskets.

On the shaft 6, the protective sleeve 11 is followed, over the region of the inlet chamber 2, by a smooth cylindrical inner body 19 which, in the region of the grinding chamber 3, is followed by the agitator body 5.

The inner body 19 forms, together with a cylindrical inner face of the inlet chamber 2, an annular gap 20 which opens into the grinding chamber 3. At a short distance in front of the grinding chamber 3, the inner body 19 forms, together with the inner face 1 of the inlet chamber 2, a dynamic friction gap 23 which serves for separating the grinding chamber 3 from the inlet chamber 2.

The agitator body 5 arranged on the shaft 6 is of essentially cylindrical design and extends over approximately the entire length of the grinding chamber 3. On its outer circumference, the agitator body 5 is equipped with a plurality of annular beads 24 which are arranged at distances from one another and which improve the grinding effect. In the present case, there are three annular beads, specifically two on the end faces of the agitator body and one in the middle. A countersunk screw 25 serves for fastening the agitator body 5 on the shaft 6, is screwed into a threaded bore 26 in the end face of the shaft 6 and with its head retains the agitator body 5 on the shaft, in the direction of the electric motor 7 the agitator body 5 being supported against the protective sleeve 11 via the inner body 19.

During operation, the grinding chamber 3 is filled with grinding balls not shown in the drawing. These are introduced into the grinding chamber 3 through an upper housing bore closeable by means of an upper plug 27 and can be removed from the grinding chamber 3 through a lower housing bore closeable by means of a lower plug 28. The plugs 27 and 28 can be inserted sealingly into the housing orifices.

In the region of the grinding chamber 3, the housing 1 is surrounded at a distance by a concentrically arranged wall 29 which, together with the outer wall of the housing 1, forms an annular chamber 30 through which cooling water can be conveyed via water connections 31. A spiral formed on the outer wall of the housing 1 and extending into the annular chamber 30 improves the cooling of the grinding chamber 3.

Located at the outlet end of the housing 1 is a cover 32 which closes the grinding chamber 3 sealingly relative to the outside. Arranged in the middle region of the cover 32 is an outlet plug 33 which has a longitudinal channel 34 and a transverse channel 35 intersecting the longitudinal channel and guided out of the plug 33 radially on one side. The outlet plug 33 is mounted rotatably in the cover 32 and is retained by means of a locking screw 36 which engages into the continuous groove 37 of the plug 33. The plug 33 can be removed by releasing the locking screw. A sieve 39 limiting the grinding chamber 3 on the outlet side is located between the inner end of the plug 33 and a retaining ring 38.

The inner end of the outlet plug 33 has a funnel-shaped widening 40 which opens into the longitudinal channel 34. Located in the entry region of the longitudinal channel 34 is an apertured diaphragm 41 which is fastened in the longitudinal channel 34 releasably and exchangeably by means of a holding ring 42.

A resistance thermocouple 43 which can be used for temperature measurements is inserted sealingly into the outwardly pointing end of the longitudinal channel 34. In a simplified version, a thermometer can also be used instead of a resistance thermocouple.

A hose nozzle 44, onto which an outlet pipe 45 is slipped, is located in the transverse channel 35 provided on one side. Alternatively, instead of an outlet pipe, a hose can also be-slipped on. Since the outlet plug 33 is rotatable, the grinding material can, if desired, also be discharged in the downward direction.

The embodiment of the grinding appliance illustrated in FIG. 1 is intended especially for flowable grinding material. A storage vessel 46 attached on top and retained by means of a double nipple 47 serves for introducing the grinding material into the inlet chamber 2. The storage vessel 46 is equipped, on its top side, with a filling orifice which can be closed by means of a cover 48. The cover 48 can be retained sealingly on the storage vessel 46 with the aid of an annular-gap connection 49. The cover 48, in its middle region, is equipped with a hose nozzle 50, to which a compressed-air hose can be connected. The grinding material located in the storage vessel 46 is subjected by the compressed-air hose to a pressure, by means of which the grinding material is pressed through the inlet chamber 2 into the grinding chamber 3 and from there through the sieve 39 and the apertured diaphragm 41 to the outlet pipe 45.

The dwell time of the grinding material in the grinding chamber 3 can be adjusted by varying the air pressure to which the storage vessel 46 is subjected. The dwell time of the grinding material can also be adjusted by means of an appropriate choice of the apertured diaphragm 41.

The rotational speed of the agitator body 5 can also be varied, according to the particular grinding material, by an appropriate control of the electric motor 7, specifically independently of the set dwell time of the grinding material in the grinding chamber.

Furthermore, the throughflow quantity of the cooling water through the annular chamber 30 and the heat dissipation can be varied.

The design of the appliance as a closed system is especially advantageous. The grinding material cannot evaporate out of the storage vessel closed off from the outside, and therefore the attendant is not troubled by harmful vapours.

Figure 2:
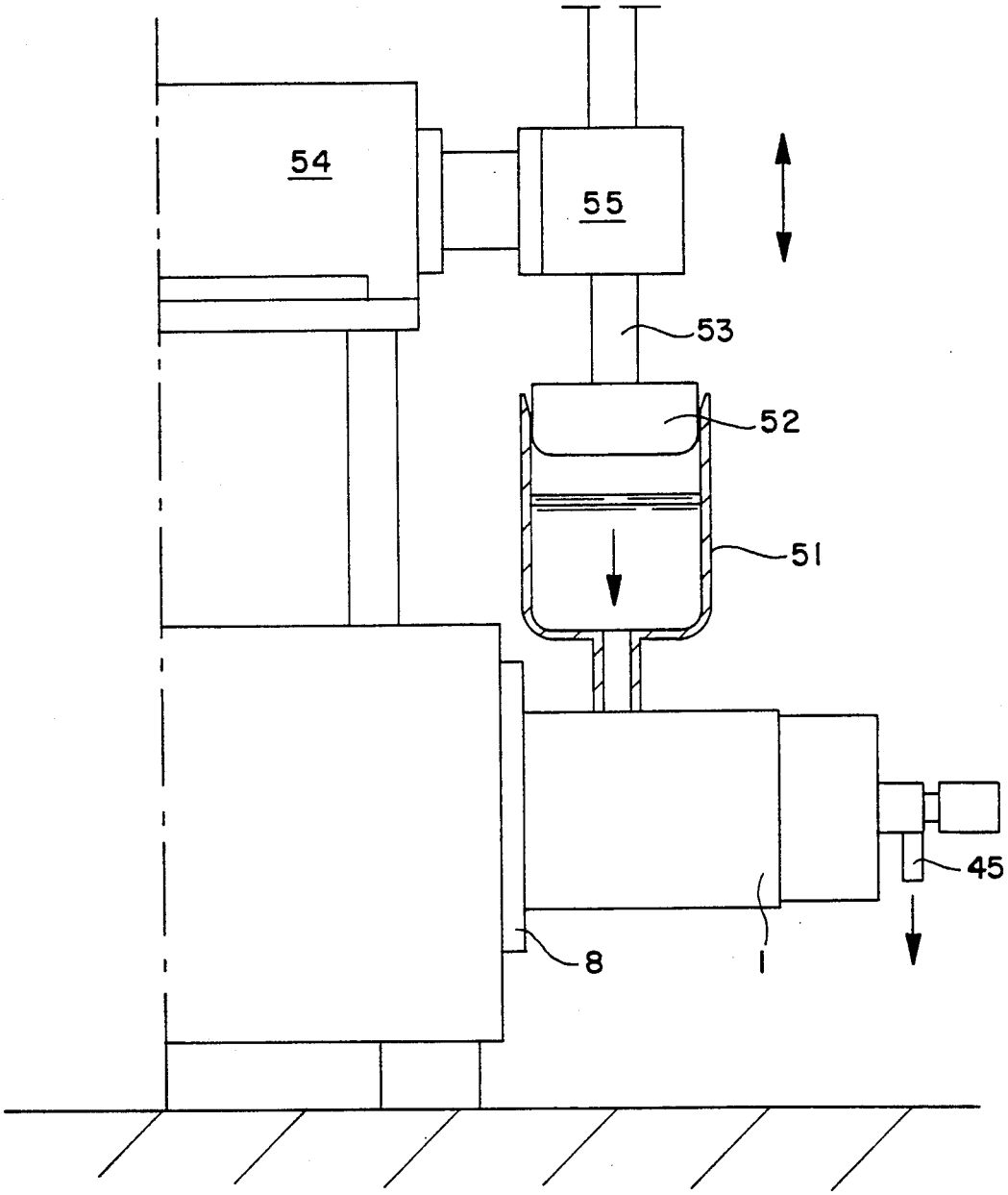
FIG. 2 shows a side view of another embodiment of the grinding appliance on a reduced scale.

The grinding appliance illustrated in FIG. 2 is of a design similar to that of the grinding appliance described above. To that extent, the same reference numerals are used for identical parts. The drawing shows only the outer contour of the housing 1 which has inside it the same parts as the housing described in FIG. 1.

In this exemplary embodiment too, the housing 1 is fastened to the electric motor 7 by means of its flange 8. In the outlet region, the outlet pipe 45 points downwards, so that the processed grinding material can be introduced into a container standing on a table top.

The inlet chamber not shown in the drawing is preceded by a cylindrical storage vessel 51, the upper end of which is open. A sealingly bearing piston 52 can be inserted into the open end. The piston 52 is arranged on the lower end of a lifting spindle 53 which can be driven in the vertical direction via a geared motor 54 and an angular gear 55.

This embodiment of the grinding appliance is especially suitable for the processing of pasty grinding material and of grinding material with a flow limit, which can be pressed through the grinding appliance by means of a piston.

Figure 3:
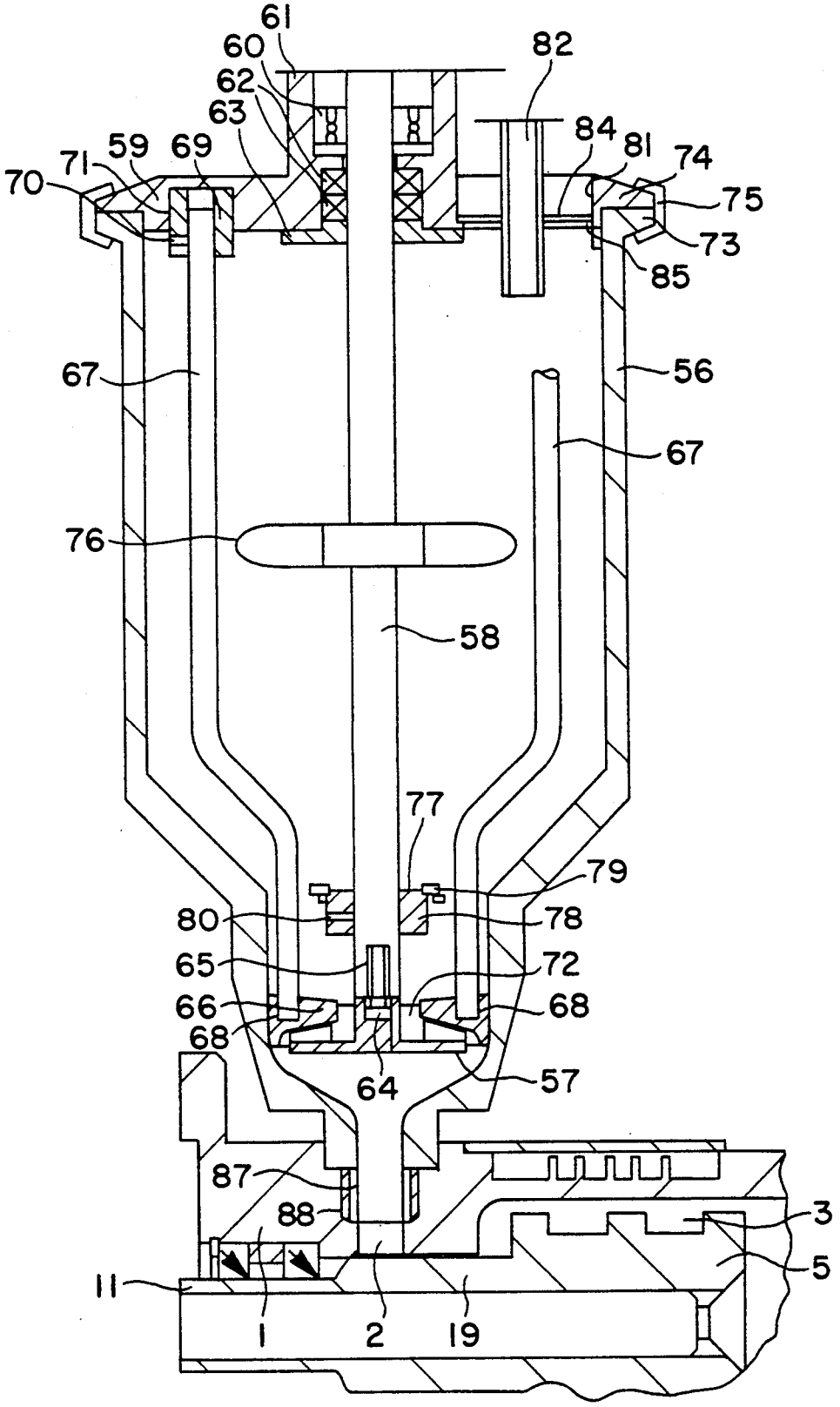
FIG. 3 shows a section through a further exemplary embodiment of a grinding appliance with an inserted return connection and FIG. 4 shows a section through the exemplary embodiment illustrated in FIG. 3, with an air-pressure connection inserted.
Figure 4:
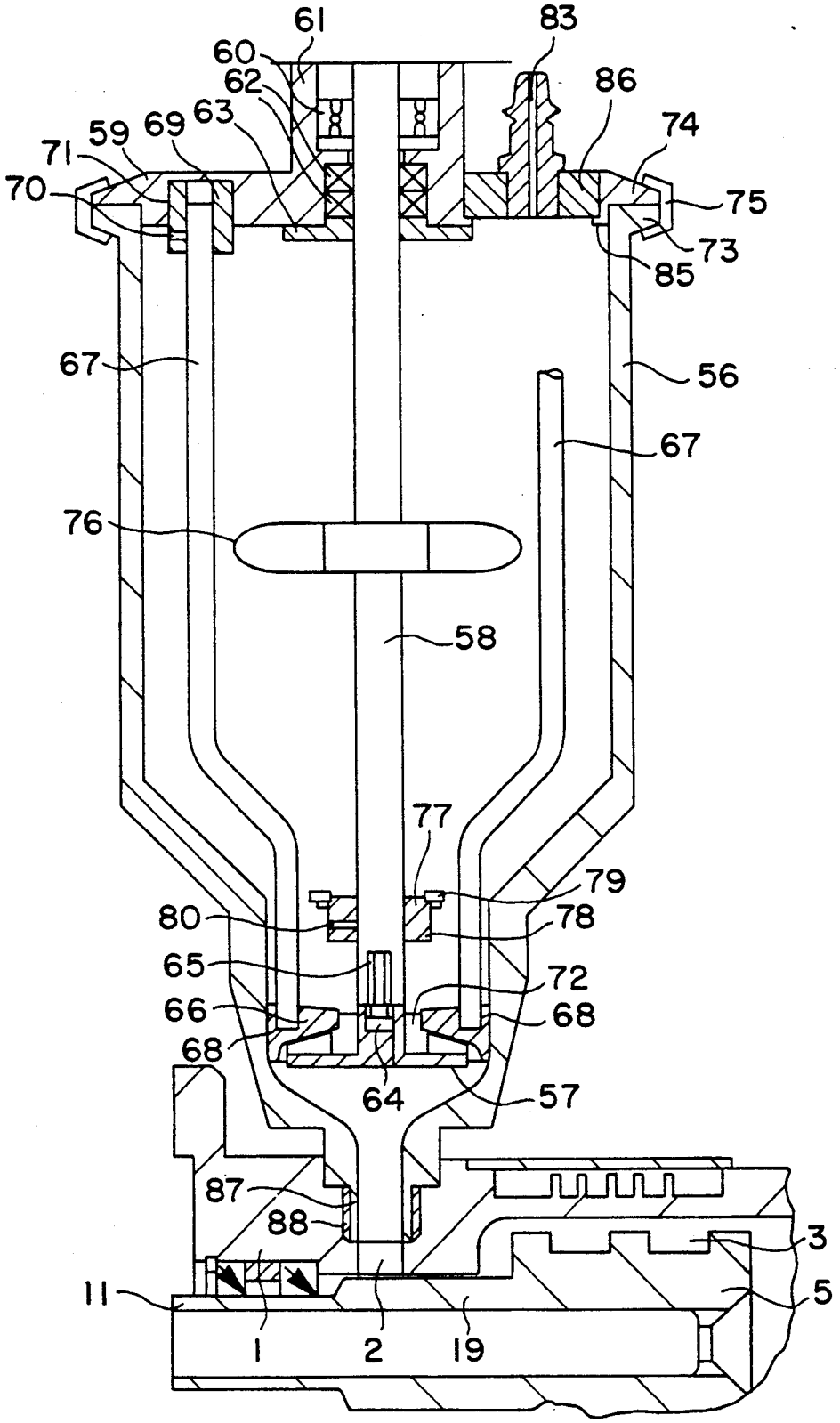

The exemplary embodiment illustrated in FIGS. 3 and 4 makes use of a storage vessel 56, in the lower region of which a centrifugal pump 57 is arranged. The storage vessel 56 consists of two essentially cylindrical parts, namely an upper part of larger diameter and a lower part of smaller diameter, which are connected to one another by means of a conical part.

The drive motor for the centrifugal pump 57 is arranged above the storage vessel 56. The shaft 58 for driving the centrifugal pump 57 engages into the storage vessel 56 vertically from above. The shaft 58 is mounted in a cover 59, by means of which the orifice serving for introducing the grinding material and located on the top side of the cylindrical storage vessel 56 can be closed. The bearing 60 is located within an outwardly pointing step 61 concentric relative to the shaft 58 and belonging to the cover 59. The bearing 60 is sealed off from the interior of the storage vessel 56 by means of sealing rings 62 arranged axially next to one another. The sealing rings 62 at the top rest against radially inwardly directed projections of the sleeve-shaped step 61 and at the bottom are held by a retaining disc 63 fastened to the cover 59.

The centrifugal pump 57 is fastened to the lower end of the shaft 58 by means of a countersunk screw 64 which is screwed into a threaded bore 65 formed in the lower end face of the shaft 58. The centrifugal pump 57 has a housing plate 66 arranged on its top side and partially surrounding its outer face. The housing plate 66 is fastened to the cover 59 of the storage vessel 56 via two retaining rods 67. Respective lower ends of the retaining rods 67 are inserted into bores 68 provided for them in the top side of the housing plate 66 and are adhesively bonded to this. The upper end of each of the retaining rods 67 is inserted into a respective bush 69 and is fastened in this by means of a setscrew 70. The bushes 69 are introduced into bores 71 provided for them in the underside of the cover 59 and are adhesively bonded to this.

The housing plate 66 is of annular design and surrounds the centrifugal pump 57 on the top side and on the radial outer face, leaving only an annular gap 72 for the passage of the grinding material. Its radial outer face rests against the inner wall of the lower part of the storage vessel 56. The housing plate 66 fastened to the cover 59 can thus be inserted positively, together with the centrifugal pump 57, into the storage vessel 56. For a better conveyance of the grinding material into the annular gap 72, the top side of the housing plate 66 is made slightly funnel-shaped.

The storage vessel 56, at its upper end, has a radially outward-projecting flange 73, against the top side of which a corresponding flange 74 of the cover 59 can be brought to bear. The cover 59 can be fastened on the storage vessel 56 by means of a clamping ring 75 engaging round the flanges 73 and 74 on the outside.

A propeller 76 is attached as an agitator member to the shaft 58 in the upper wider part of the storage vessel 56. To avoid impeding the propeller 76, the retaining rods 67 are bent outwards in the upper region of the storage vessel 56 according to the shape of the latter. Even relatively large agitator members can consequently be attached; this is necessary in order to achieve a sufficiently thorough mixing at higher viscosities or at lower rotational speeds. The propeller 76 rotating together with the centrifugal pump 57 serves for the complete mixing of the grinding material in the upper part of the storage vessel 56.

Furthermore, a dissolver disc 77 with radially outward-pointing tooth-shaped elements 79 is arranged on the shaft 58 in the lower part of the storage vessel 56. The dissolver disc 77 is attached to a bush 78 which is fastened to the shaft 58 by means of a setscrew 80. By means of the dissolver disc 77, a uniform distribution of the grinding material in the space above the centrifugal pump 57 is obtained.

An orifice 81 for inserting a return connection 82 or an air-pressure connection 83 is formed in the cover 59 radially on the outside. FIG. 3 shows the return connection 82, whilst FIG. 4 illustrates the air-pressure connection 83.

As emerges from FIG. 3, the return connection 82 is designed in the form of a hose which extends axially through the circular orifice 81. The hose leads through an annular inspection glass disc 84. The inspection glass disc 84 carrying the return connection 82 is inserted positively into the orifice 81 from above and is retained at the lower end of the orifice 81 by an annular flange 85 pointing radially inwards.

The return connection 82 is connected to the outlet of the grinding chamber 3 which is designed in the same way as in the exemplary embodiments illustrated in FIGS. 1 and 2. By means of the return connection 32, the product ground during one pass is fed to the storage vessel 56 again. The grinding material can thus pass through the appliance as often as desired. In the last pass, the junction between the return connection 82 and the outlet of the grinding chamber 3 is broken and the ground material is extracted from the outlet. However, the conveyance of the grinding material by means of the centrifugal pump 57 is terminated when the quantity of grinding material in the storage vessel 56 has gone more or less completely through the housing plate 66 of the centrifugal pump 57. As provided, the remainder of the grinding material left in the space underneath the centrifugal pump 57, in the storage vessel 56, in the inlet chamber 2 and in the grinding chamber 3 is then pressed out of the appliance by means of compressed air.

For this purpose, as shown in FIG. 4, the return connection 82, together with the inspection glass disc 84, is taken out of the orifice 81 in the cover 59 of the storage vessel 56 and replaced by an air-pressure connection 83. The air-pressure connection 83 is designed as a hose nozzle, to which a compressed-air hose can be connected. The hose nozzle is arranged in an annular plug 86 and is adhesively bonded to this. The plug 86 is inserted, together with a gasket, into the orifice 81 in the cover 59.

As emerges from FIGS. 3 and 4, in a similar way to the exemplary embodiments shown in FIGS. 1 and 2 the storage vessel 56 is placed onto the inlet chamber 2 from above and fastened to the housing 1. For the fastening, there is an external thread 87 which is arranged at the lower end of the storage vessel 56 and which is screwed into a corresponding internal thread 88 countersunk in the housing 1 above the inlet chamber 2 and is sealed off therein by means of a sealing ring.

As also emerges from FIGS. 3 and 4, the agitator body 5, the inner body 19 and the protective sleeve 11 are designed as a whole as a single part. This onepiece design makes it easier to clean the parts arranged inside the appliance.

All the further parts inside the appliance are identical to the parts shown in FIG. 1, and therefore there is no need to describe them in relation to the exemplary embodiment described in FIGS. 3 and 4.

I claim:

1. A grinding apparatus adapted for grinding material in the form of flowable or a pasty nonflowable conglomerate material comprising a housing (1), said housing including an inlet through which material which is to be ground is introduced into an inlet chamber (2), a grinding chamber (3) in fluid communication with said inlet chamber (2), a plurality of grinding balls in said grinding chamber (3), an outlet (4) through which ground material exits said outlet (4), an agitator body (5) in said grinding chamber (3) for effecting agitation of said grinding balls, pressure vessel means (46, 51, 56) for housing the material which is to be ground incident to its flow through said housing (1), removable closure means (48, 52, 59) for introducing the material to be ground into said pressure vessel means (46, 56) and closing said pressure vessel means (46, 56), and means (50, 52–55, 57) for pressurizing the material which is to be ground while in said pressure vessel means (46, 51, 56) and while closed by said removable closure means (48, 52, 59) sufficient to press the material to be ground through the inlet and grinding chambers (2, 3, respectively) and into said outlet (4).

2. The grinding apparatus as defined in claim 1 wherein said pressurizing means (50) includes an air-pressure connector.

3. The grinding apparatus as defined in claim 1 wherein said pressurizing means includes a pump (57) located within said pressure vessel means (56), drive motor means for driving said pump (57) being located exteriorly of said pressure vessel means (56), and a drive shaft (58) connected between said pump and drive motor means.

4. The grinding apparatus as defined in claim 1 wherein said pressurizing means includes a pump (57) located within said pressure vessel means (56), drive motor means for driving said pump (57) being located exteriorly of said pressure vessel means (56), a drive shaft (58) connected between said pump and drive motor means, and said drive shaft (58) passes through said removable closure means (59).

5. The grinding apparatus as defined in claim 1 wherein said pressurizing means includes a pump (57) located within said pressure vessel means (56), drive motor means for driving said pump (57) being located exteriorly of said pressure vessel means (56), a drive shaft (58) connected between said pump and drive motor means, and means (67) for supporting said pump (57) from said removable closure means (59).

6. The grinding apparatus as defined in claim 1, wherein said pressurizing means includes an artificial pump (57) located within said pressure vessel means (56), drive motor means for driving said artificial pump (57) being located exteriorly of said pressure vessel means (56), and a drive shaft (58) connected between said artificial pump and drive motor means.

7. The grinding apparatus as defined in claim 1 wherein said pressurizing means includes a pump (57) located within said pressure vessel means (56), drive motor means for driving said pump (57) being located exteriorly of said pressure vessel means (56), a drive shaft (58) connected between said pump and drive motor means, means (67) for supporting said pump (57) from said removable closure means (59), said pump supporting means (67) include a plurality of rods having first ends secured to said removable closure means (59) and second ends carrying an annular plate (66) housing said pump (57), and said annular plate (66) being supported by a lower end portion of said pressure vessel means (56).

8. The grinding apparatus as defined in claim 1 including means (82) passing through said removable closure means (59) and being connected to said outlet (4) for effecting the flow of material from said outlet (4) back into said pressure vessel means (56).

9. The grinding apparatus as defined in claim 1 including means (76) in said pressure vessel means (56) for agitating the material therein.

10. The grinding apparatus as defined in claim 1 wherein said pressurizing means includes a pump (57) located within said pressure vessel means (56), and means (78, 79) associated with said pump (57) for effecting uniform distribution of the material within said pressure vessel means (56).

11. The grinding apparatus as defined in claim 1 wherein said pressurizing means includes a pump (57) located within said pressure vessel means (56), a shaft (58) for operating said pump (57), means (76) carried by said shaft (58) for agitating material within said pressure vessel means (56), and means (78, 79) carried by said shaft (58) for effecting uniform distribution of the material within said pressure vessel means (56).

12. The grinding apparatus as defined in claim 1 including throttle means (41) for throttling the flow of material through said outlet (4).

13. The grinding apparatus as defined in claim 1 including throttle means (41) for throttling the flow of material through said outlet (4), and said throttle means (41) is an apertured diaphragm.

14. The grinding apparatus as defined in claim 1 including throttle means (41) for throttling the flow of material through said outlet (4), and said throttling means (41) is an interchangeable apertured diaphragm.

15. The grinding apparatus as defined in claim 1 wherein said outlet (4) includes a removable plug (33) having a concentric longitudinal channel (34), and throttle means (41) housed in said longitudinal channel (34).

16. The grinding apparatus as defined in claim 1 wherein said outlet (4) includes a removable plug (33) having a concentric longitudinal channel (34), throttle means (41) housed in said longitudinal channel (34), and said throttle means (41) is an apertured diaphragm.

17. The grinding apparatus as defined in claim 1 wherein said outlet (4) includes an outlet plug (33) having a transverse channel (35) which radially intersects a longitudinal channel (34) of said outlet plug (33), and means for rotatably fastening said outlet plug (33) relative to said housing (1).

18. The grinding apparatus as defined in claim 1 wherein said inlet chamber (2) includes an annular gap (20) opening into said grinding chamber (3).

19. The grinding apparatus as defined in claim 1 wherein said inlet chamber (2) includes an annular gap (20) opening into said grinding chamber (3), and a dynamic friction gap (23) between said annular gap (20) and said grinding chamber (3).

20. The grinding apparatus as defined in claim 1 wherein said inlet chamber (2) includes upstream and downstream generally normally disposed bores, a protective sleeve (11) and an inner body (19) aligned relative to each other and being housed in said downstream bore, and a drive shaft (6) connected to said agitator body (5) being disposed internally of said protective sleeve (11) and said inner body (19).

21. The grinding apparatus as defined in claim 1 wherein said removable closure means (52) is a piston, a spindle (53) connected to said piston (52), and said pressurizing means (50, 52–55, 57) includes said piston (52) and means (54, 55) for moving said piston (52) into said pressure vessel means (51) for progressively lessening the volume thereof.

22. The grinding apparatus as defined in claim 1 wherein said pressurizing means (50, 52–55, 57) includes a pump (57) upstream of said inlet chamber (2) and within said pressure vessel means (56).

* * * * *